US007753552B2

(12) United States Patent
Mirica et al.

(10) Patent No.: US 7,753,552 B2
(45) Date of Patent: Jul. 13, 2010

(54) QUICK INSTALL CANOPY

(75) Inventors: Viorel Mirica, Brossard (CA); Patrick Martineau, Ile-Perrot (CA)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/370,626

(22) Filed: Feb. 13, 2009

(65) Prior Publication Data

US 2009/0225535 A1 Sep. 10, 2009

Related U.S. Application Data

(60) Provisional application No. 61/068,587, filed on Mar. 7, 2008.

(51) Int. Cl.
*F21S 8/04* (2006.01)

(52) U.S. Cl. ..... 362/147; 362/404; 362/370; 362/432

(58) Field of Classification Search ..... 362/147, 362/368, 370, 404, 432, 812; 40/606.01, 40/606.03, 606.14, 606.15, 611.01, 611.05–611.07, 40/611.13, 607.13, 607.15, 617
See application file for complete search history.

(56) References Cited

U.S. PATENT DOCUMENTS 5,272,605 A 12/1993 Johnstone
5,349,513 A * 9/1994 Taylor, III ..... 362/404
5,376,020 A 12/1994 Jones
5,461,550 A 10/1995 Johnstone
5,727,867 A 3/1998 Johnstone
6,082,031 A 7/2000 Heaton et al.
6,132,070 A 10/2000 Vosika et al.
7,014,332 B2 3/2006 Sergio et al.
7,350,327 B1 * 4/2008 Logan et al. ..... 40/570

* cited by examiner

*Primary Examiner*—Thomas M Sember
(74) *Attorney, Agent, or Firm*—Hoffman & Baron, LLP

(57) ABSTRACT

An assembly and a method for attaching a sign-type lighting fixture to an electrical box. The assembly includes a lighting fixture having a mounting plate affixed to the electrical box, an illuminating sign, and a canopy affixed to the lighting fixture, allowing the canopy and the mounting plate to attach quickly. The method first includes affixing a mounting plate to an electrical box and affixing a canopy to a sign-type lighting fixture. Next, the canopy is secured to the mounting plate by inserting at least one wing tab from the canopy through at least one holding tab on the mounting plate. Then, the electrical wiring is connected. After that the wing tab and holding tab are separated. Finally, the wing tab is inserted into at least one offset on the mounting plate, and the canopy is secured to the mounting plate.

18 Claims, 8 Drawing Sheets

DETAIL A

DETAIL B

DETAIL C

DETAIL D

QUICK INSTALL CANOPY

CROSS-REFERENCE TO RELATED APPLICATIONS

This application claims priority to U.S. Provisional Patent Application No. 61/068,587 filed on Mar. 7, 2008, the contents of which are incorporated herein by reference in entirety.

FIELD OF INVENTION

The present invention relates generally to a lighting fixture assembly of the type used to support signage such as an emergency exit sign. More particularly, the present invention relates to an emergency exit sign lighting fixture which may be quickly and easily installed.

BACKGROUND

The need for illuminated signage, such as exit signs, in buildings and other public areas is well known. These signs typically include lighting fixtures having a housing which supports internal illumination for illuminating a sign supported by the housing. These fixtures are usually mounted in elevated locations by use of a canopy.

In common installation, a canopy is secured to the lighting fixture. The canopy is then attached to the electrical box which typically includes a mounting plate attached thereto. The canopy and mounting plate allow for attachment of the fixture to electrical box in either a ceiling or a wall. Additionally, the canopy and mounting plate allow the passage of electrical wires therethrough to supply power to the illuminating means in the lighting fixture. Many of these fixtures, including the canopy, are formed from sheet metal steel or plastic.

As these sign-type lighting fixtures are typically installed in elevated locations, they are often awkward to access. It can be appreciated that the installer needs to employ installing screws and tools such as screwdrivers, while also wiring the fixture to the electrical box. The installation process is difficult and time consuming. As the installer must hold the fixture open while attempting to make the electrical connections, hardware may be provided to temporarily hang the fixture while wiring is being done. However, such hardware can become misplaced or dropped, further increasing the time and cost of installation.

It is therefore desirable to provide a lighting fixture assembly including a lighting fixture attachable to a canopy without the use of separate fastening hardware.

SUMMARY OF THE INVENTION

The present invention provides a sign-type lighting fixture assembly for mounting a lighting fixture to an electrical box. The assembly includes a mounting plate affixed to the electrical box, a sign with a lighting fixture for illuminating the sign, and a canopy affixed to the lighting fixture. A canopy is provided for attaching the fixture to the box and permitting passage of electrical wiring from the box into the lighting fixture for supplying power to the illuminating means in a normal fashion. The canopy includes at least one wing that can be connected to at least one holding tab bent out from the mounting plate at a right angle. This allows temporary attachment of the canopy to the mounting plate without additional securement hardware.

After the wire connections are made, the wing and the holding tab are detachable. The wing on the canopy is then inserted into the offset on an edge of the mounting plate and secured into place. This canopy design may be used to mount a sign-type lighting fixture to either to a wall or a ceiling.

The present invention also includes a method for attaching a sign-type lighting fixture to an electrical box. First, a mounting plate is affixed to an electrical box and a canopy is affixed to a sign-type lighting fixture. Next, the canopy is secured to the mounting plate by inserting at least one wing from the canopy through at least one holding tabs on the mounting plate. Then, electrical wires are connected. After that, the wing and holding tab are separated. Finally, the wing is inserted into an offset on the mounting plate and the canopy is secured to the mounting plate.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF DRAWINGS

Figure 2:
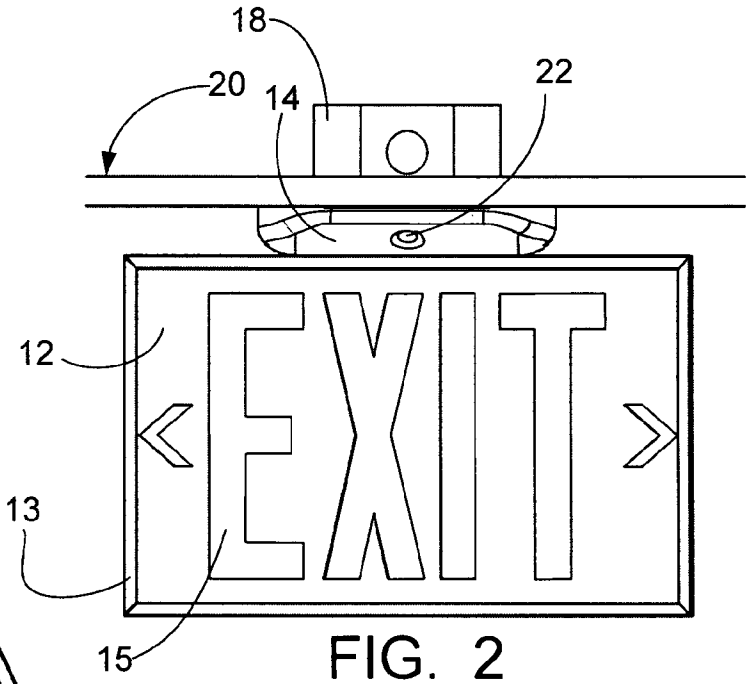
FIG. 2 shows a front view of the sign-type lighting fixture assembly of the present invention fully attached to the ceiling.
Figure 3:
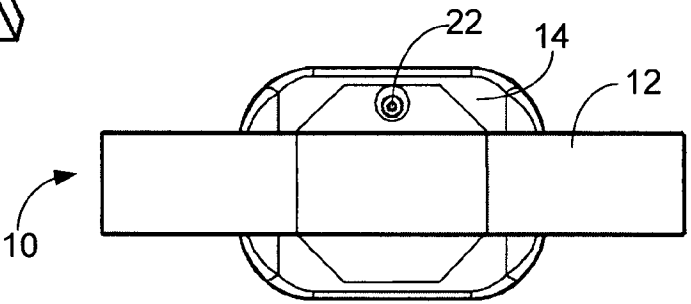
FIG. 3 shows a bottom view of the sign-type lighting fixture assembly of the present invention fully attached to the ceiling.

The present invention provides a mounting plate and a canopy for quickly and easily attaching a sign-type lighting fixture to a wall or a ceiling. The assembly and method of the present invention contains two main parts, a mounting plate attached to an electrical box and a canopy attached to a sign.

FIGS. 1 through 4 show the sign-type lighting fixture assembly of the present invention. The assembly 10 includes a lighting fixture 12, a canopy 14, and a mounting plate 16. The assembly 10 permits mounting of the fixture to an electrical box 18 located on a wall or ceiling 20.

The lighting fixture 12 is an illuminated sign, well known in the art, typically having a perimetrical wall structure 13, including top, bottom, and opposing side walls. The perimetrical wall structure defines a generally rectangular configuration. The perimetrical wall structures support front and back signage 15, which typically have a translucent or opaque character allowing for the sign to be appropriately back lit. The perimetrical wall structure supports illuminating elements (not shown), which support back light illumination for signage.

Figure 5:
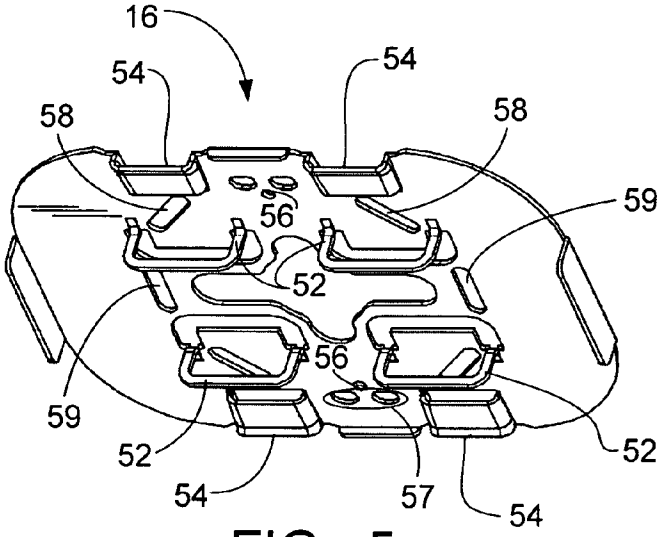
FIG. 5 shows a view of the bottom of the mounting plate for the sign-type lighting fixture assembly of the present invention.
Figure 6:
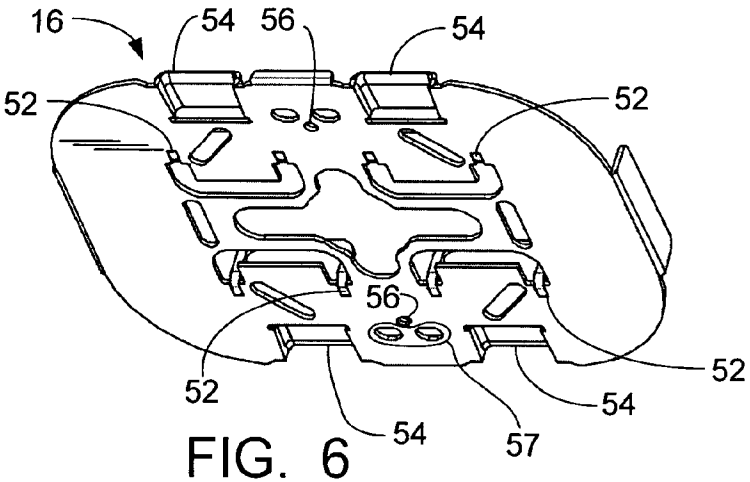
FIG. 6 shows a view of the top of the mounting plate for the sign-type lighting fixture assembly of the present invention.

Referring to FIGS. 5 and 6, the mounting plate 16 is generally a planar rectangular member preferably formed of metal. In the present invention, the mounting plate 16 is attached directly to the electrical box 18 via a set of screws. Note that the mounting plate 16 has horizontal and vertical symmetry; preventing a wall mounted sign-type fixture from being installed the wrong way; i.e., upside down.

The mounting plate 16 includes two pairs of U-shaped holding tabs 52, two pairs of offsets 54, and multiple pairs of mounting plate screw holes 56-59. The U-shaped holding tabs 52 are bent out from the mounting plate at a right angle. The two pairs of offsets 54 are arranged in such a way that two opposing pairs of offsets 54 are symmetrically located on two opposing edges of the mounting plate 50.

The mounting plate screw holes 56-59 are also symmetrical. For example, the screw holes 56 are aligned to match each pair of offsets 54 to the mounting plate screw hole 56 on the opposite side, allowing for securement of the canopy to the mounting plate with a single screw. The present invention further contemplates the use of two screws, as illustrated by screw holes 57-59. For example, two screws may be necessary when the lighting fixture 12 is heavy. A further embodiment also contemplates the use of other means of attachment, such as a snap instead of a screw.

Figure 7:
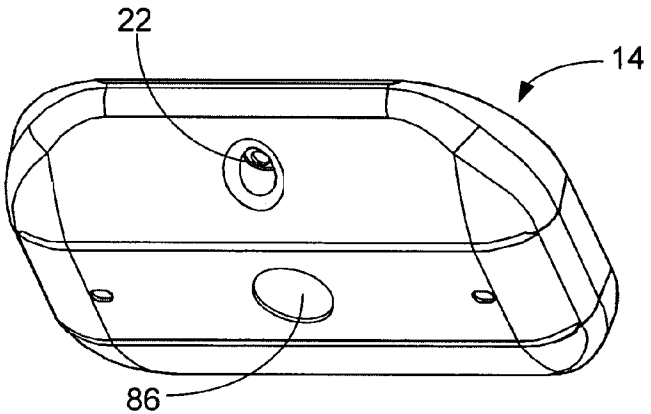
FIG. 7 shows a view of the bottom of the canopy for the sign-type lighting fixture assembly of the present invention.
Figure 8:
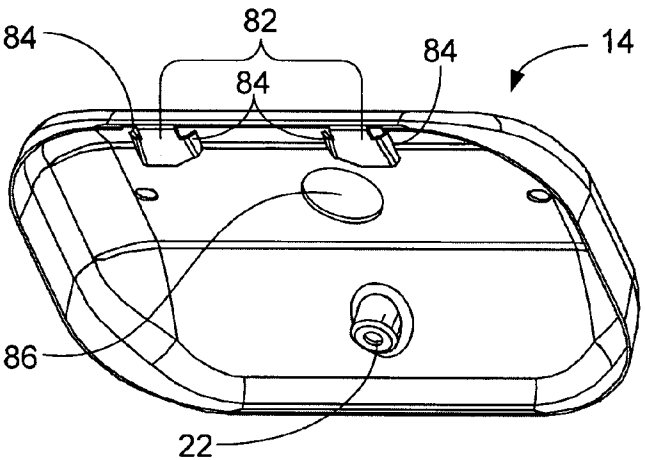
FIG. 8 shows a view of the top of the canopy for the sign-type lighting fixture assembly of the present invention.
Figure 14:
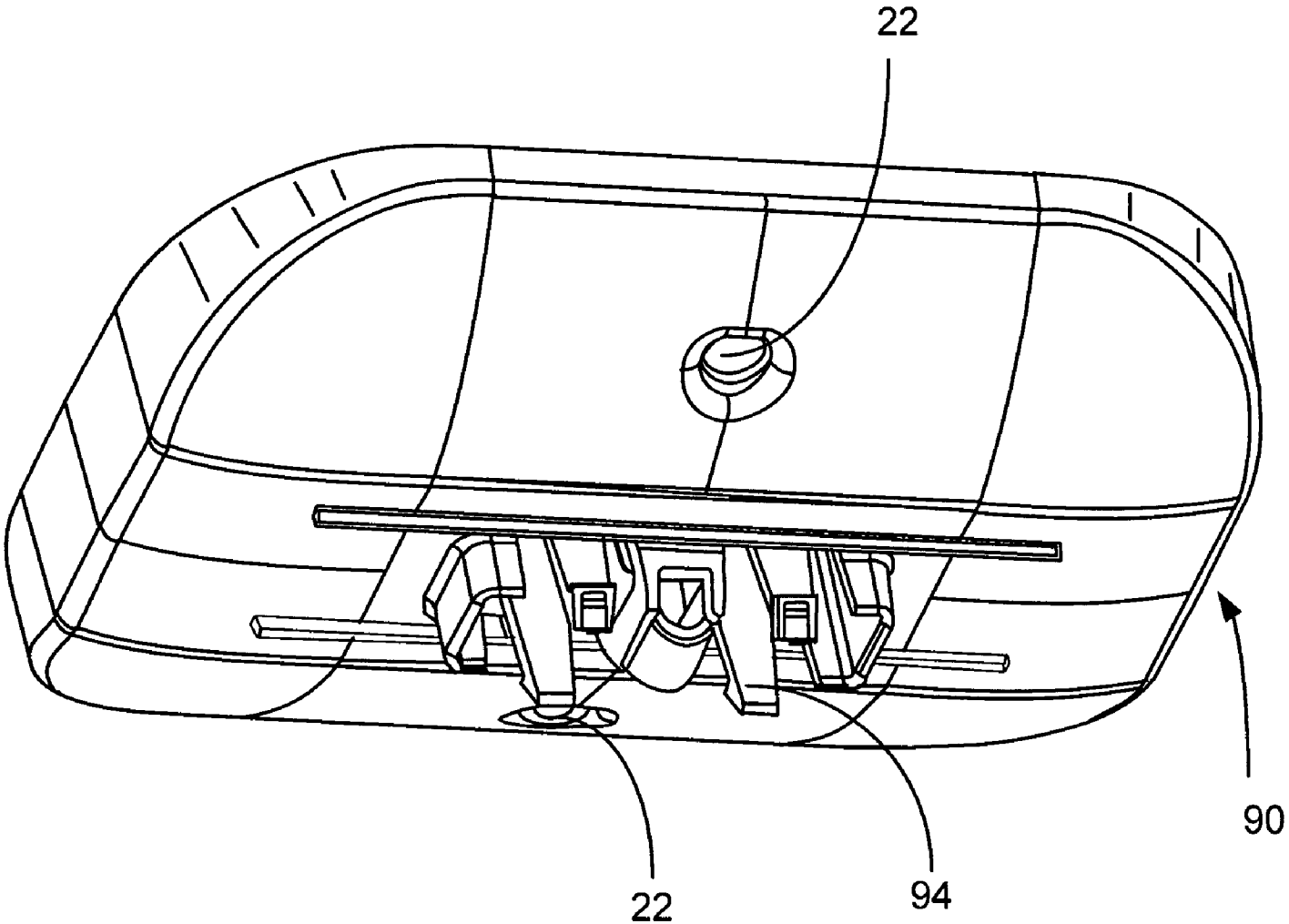
FIG. 14 shows a view of the bottom of the canopy for the sign-type lighting fixture assembly of the present invention with a plastic canopy.
Figure 15A:
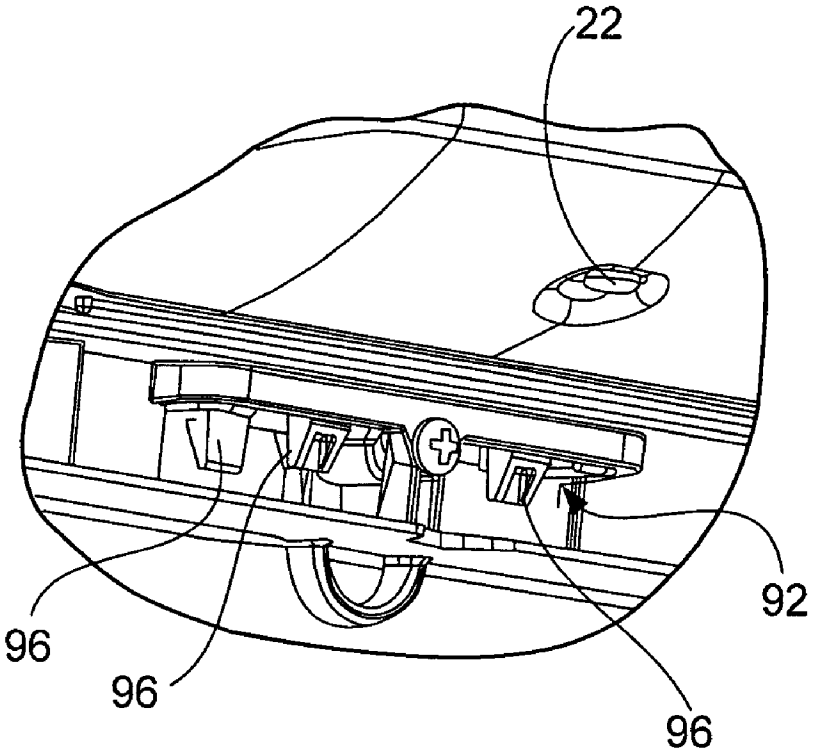
FIG. 15 shows a ceiling assembly of the sign-type lighting fixture of the present invention with a plastic canopy.
Figure 15:
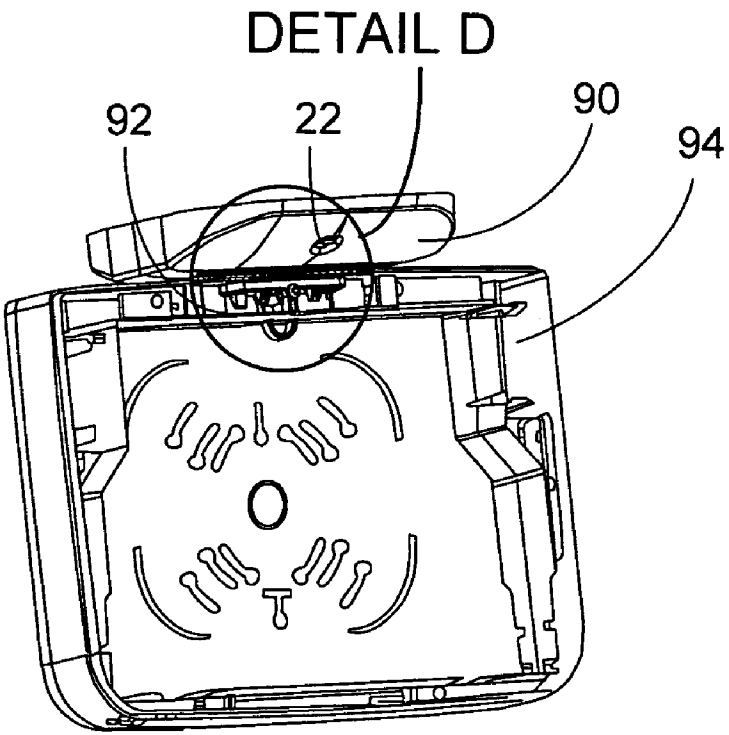

Referring to FIGS. 7 and 8, the canopy 14 is designed for attachment to the mounting plate 16. The canopy 14 is typically formed of metal or plastic. The canopy 14 in FIGS. 1-13 is shown in metal, but FIGS. 14-15A provide an example of the present invention with a plastic canopy 90. The canopy 14 is attached to the lighting fixture 12 in a normal fashion, such as being snapped on to a housing of the lighting fixture 12 or installed with screws.

The canopy 16 includes a pair of wing tabs 82 each having wings 84 that are secured to the U-shaped holding tabs 52 on the mounting plate 16, allowing the canopy 14 to be temporarily attached to the mounting plate 16 during installation, as will be further described below. The wing tabs 82 are designed in such a manner that the wing tabs 82 are bent out from the canopy at generally a right angle and the wings 84 lie in a plane different from the wing tabs 82.

The canopy 14 further includes a central opening 86, through which electrical wires may pass to connect the sign to the electrical box. Additionally, the canopy 14 includes one canopy screw hole 22 which is aligned with either of the mounting plate screw holes 56 to secure the mounting plate 16 to the canopy 14.

The canopy screw hole 22 and mounting plate screw holes 56 are self-aligned when wings 84 on the canopy 14 are inserted into the offsets 54 on the mounting plate 16. This prevents the problem of misalignment between the canopy screw hole 22 and the mounting plate holes 56. Moreover, the canopy 14 of the present invention is different than most canopies on the market, which require electrical wiring connections to be made while the installer is holding the lighting fixture 12.

Having described the components of the present invention, the installation of the assembly 10 may now be described.

Figure 1:
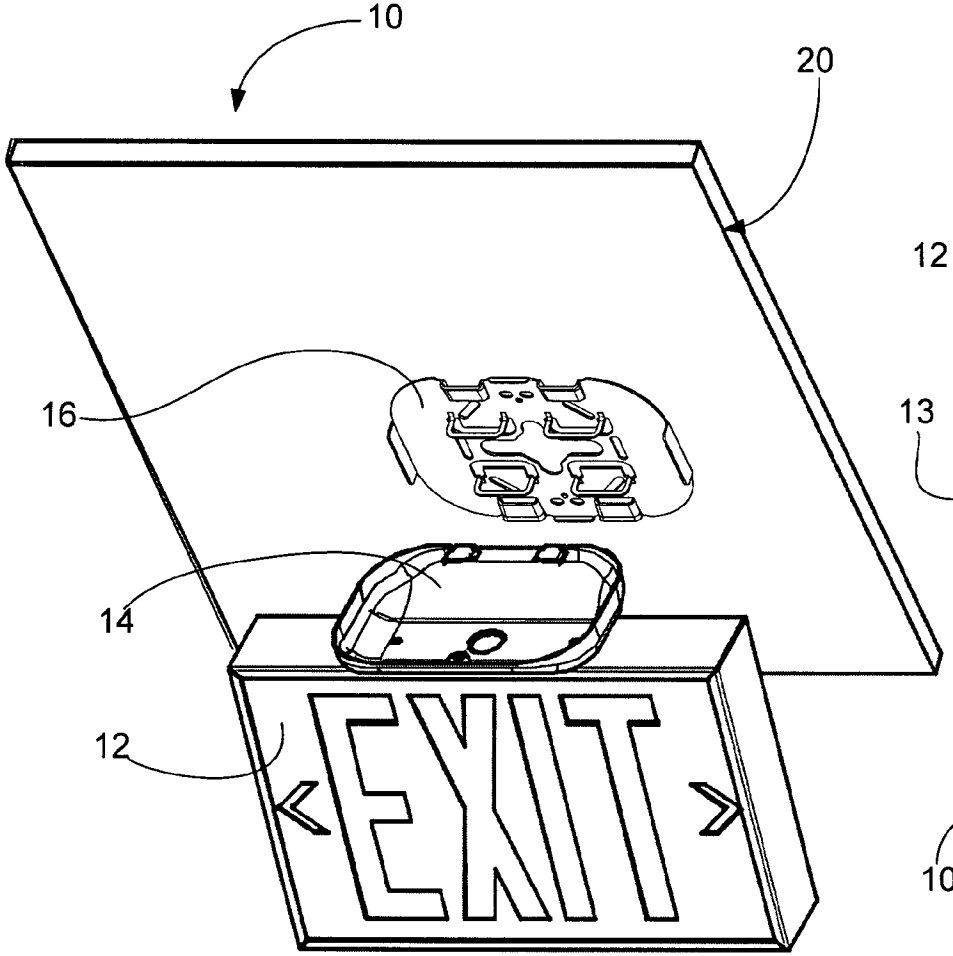
FIG. 1 shows the sign-type lighting fixture assembly of the present invention prior to installation.

Referring to FIG. 1, the mounting plate 16 is attached directly to the electrical box and the canopy 14 is attached to the lighting fixture 12 prior to assembly. Such affixing is done in accordance with common practice.

Figure 9:
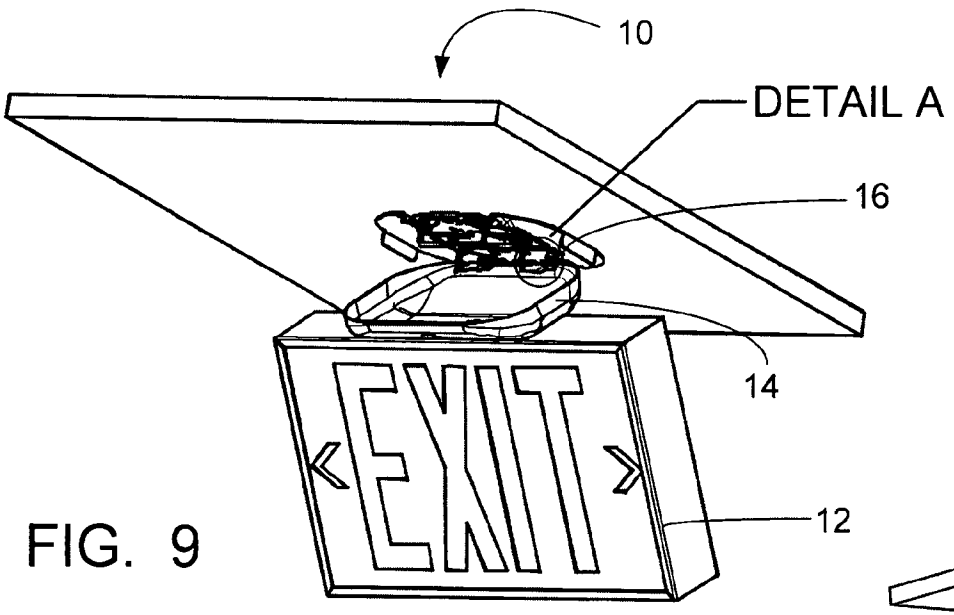
FIG. 9 shows a ceiling assembly of the sign-type lighting fixture of the present invention with the canopy and lighting fixture temporarily attached to the mounting plate with U-shaped holding tabs and wings.
Figure 9A:
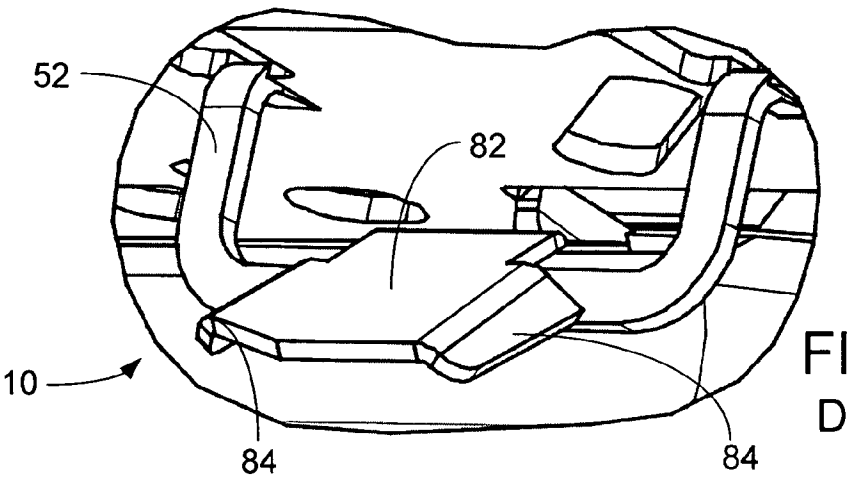

Then, referring to FIG. 9, the installer inserts the pair of wing tabs 82 on the canopy 14 through one of the pairs of U-shaped holding tabs 52 on the mounting plate 16. Then, the installer performs the wire connections, with two free hands. FIG. 9A shows a detailed view of one of the wing tabs 82 inserted through one of the U-shaped holding tabs 52 for temporary attachment of the canopy 14 to the mounting plate 16, while wires are connected. FIG. 9A also shows how the wings 84 lie in a plane different from that of the wing tabs 82. The benefit of such design is that the wings 84 prevent the canopy 14 from falling or separating from the mounting plate's U-shaped holding tabs 52 when hung in such a manner.

Figure 10:
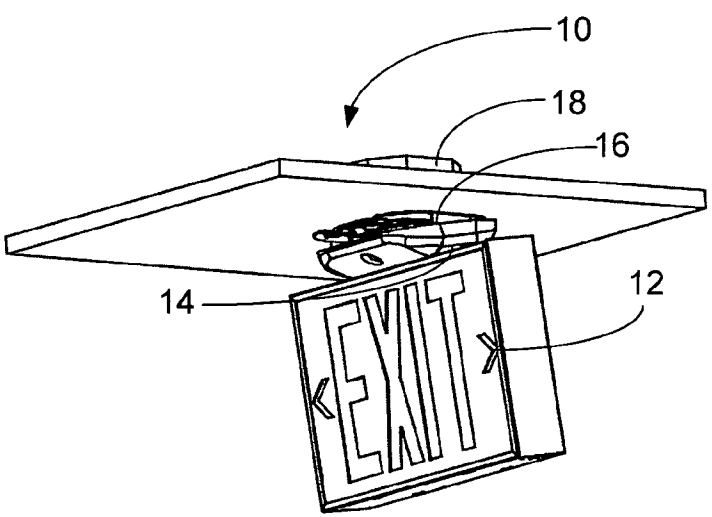
FIG. 10 shows the assembly of the sign-type lighting fixture of the present invention after the wires are attached and the wings are being slid into the offsets on the mounting plate.

After the wire connections are complete, the installer separates wings 84 from the U-shaped holding tabs 52 and inserts the wing tabs 82 into the offsets 54 located on the mounting plate 16, as shown in FIG. 10.

Figure 11:
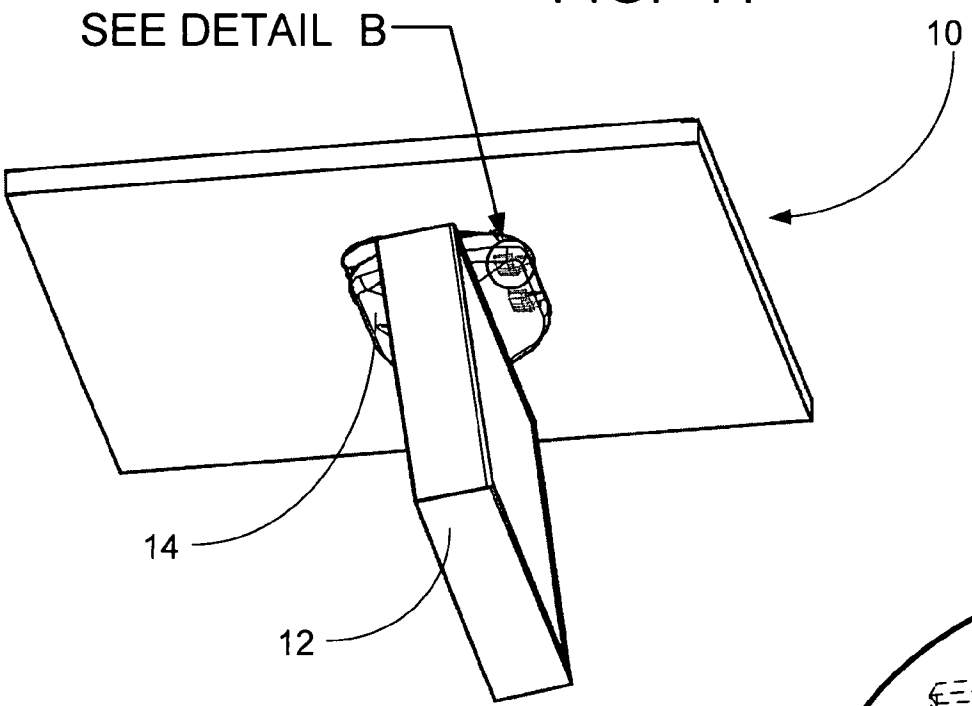
FIG. 11 shows the assembly of the sign-type lighting fixture of the present invention when the wings are slid into the mounting plate offsets.
Figure 11A:
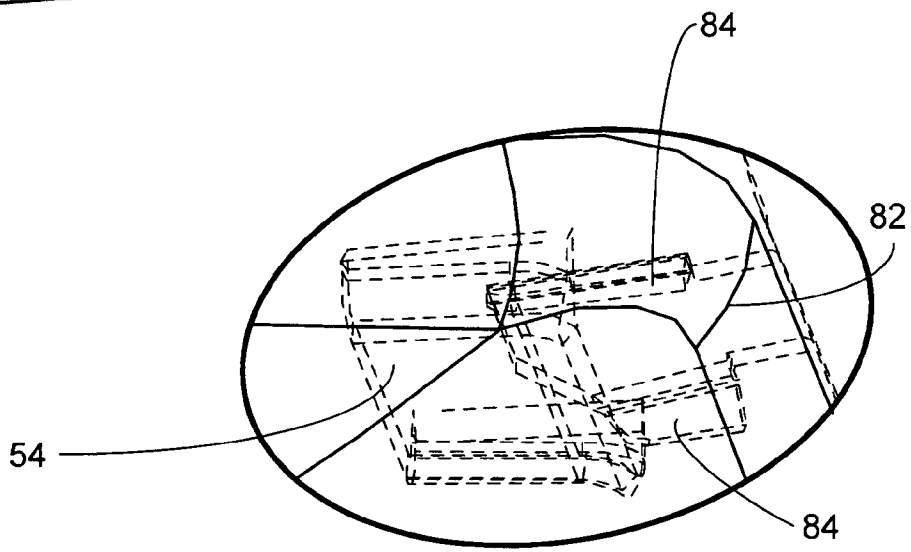

Referring to FIG. 11, the insertion of the wing tabs 82 into the offsets 54 allows the installer to easily align the canopy 14 and mounting plate 16 and slide the canopy 14 into the final position. FIG. 11A shows a detailed view of one of the wing tabs 82 being slid into one of the offsets 54 on the mounting plate 16.

Figure 4:
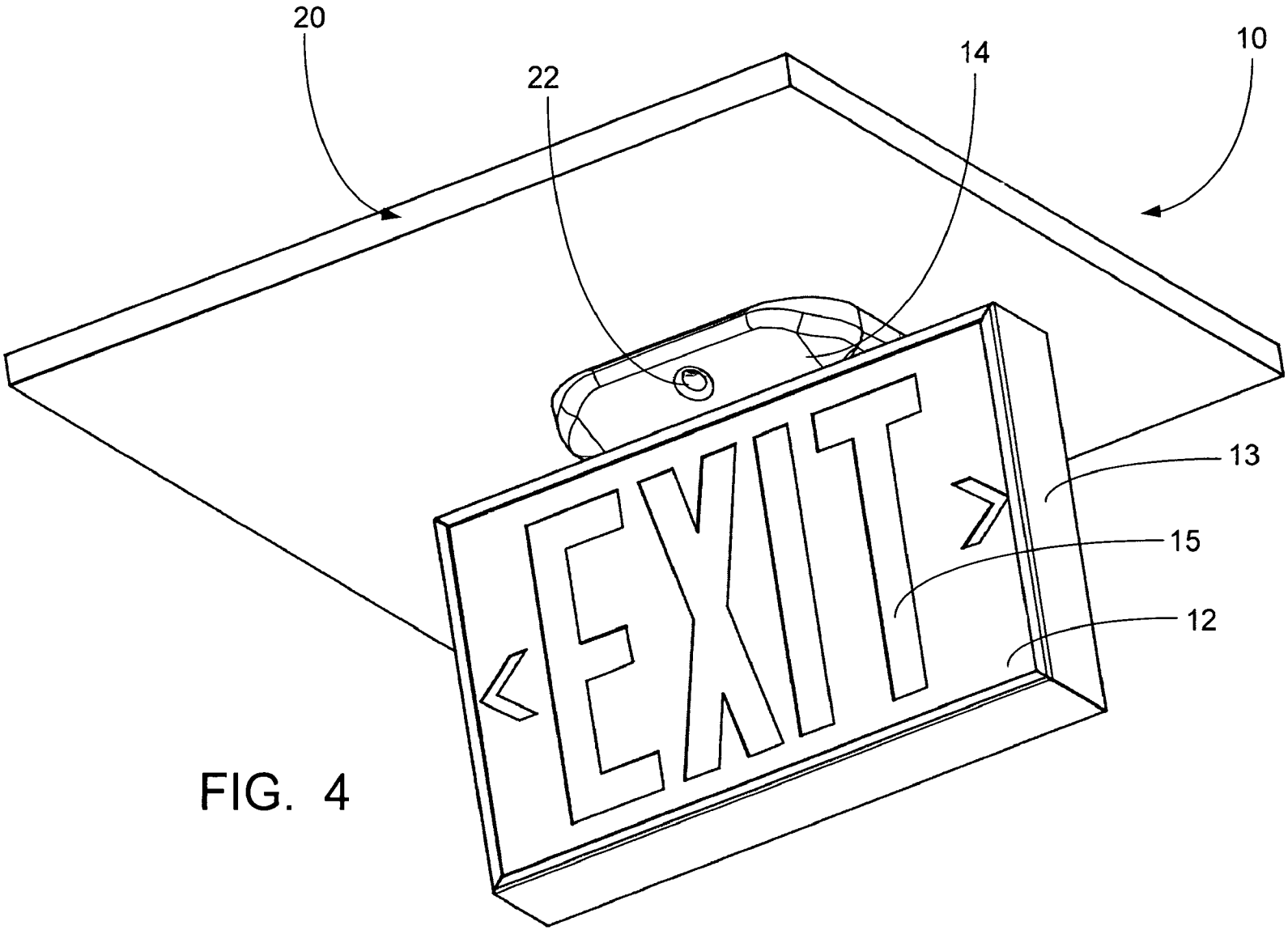
FIG. 4 shows the sign-type lighting fixture assembly of the present invention fully assembled on the ceiling.

When the canopy 14 is in the final position, as shown in FIG. 4, the mounting plate 16 and canopy 14 are properly aligned, allowing the installer to secure the canopy to the mounting plate by inserting one screw through the canopy screw hole 22 and the mounting plate screw hole 56, positioned on the side of the mounting plate opposite the pair of offsets 54 where the wing tabs 82 have been inserted. The screw is preferably secured to the mounting plate 16 and canopy 14, but not the electrical box under the mounting plate 16.

Figure 12:
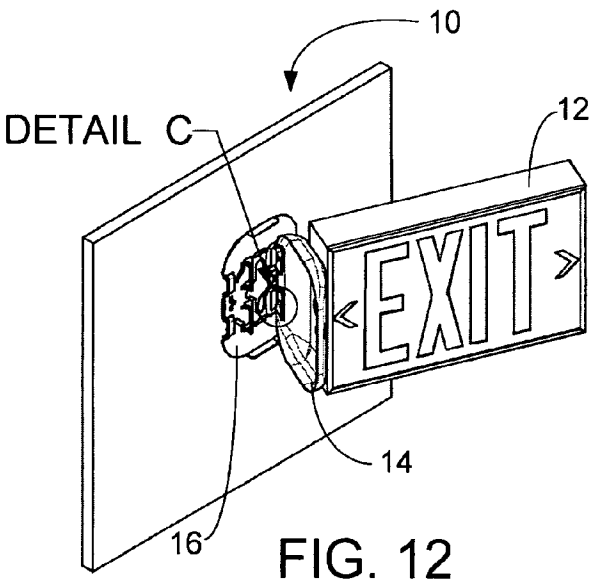
FIG. 12 shows a wall assembly of the sign-type lighting fixture of the present invention with the canopy and lighting fixture temporarily attached to the mounting plate with the U-shaped holding tabs and wings.
Figure 12A:
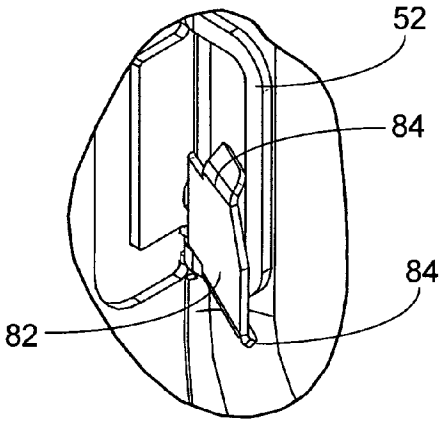

A further feature of the present invention is that the assembly 10 also provides mounting to a vertical wall. FIG. 12 shows the canopy 14 and mounting plate 16 attached to a wall. A detailed view of how to attach the canopy 14 to the mounting plate 16 in a wall installation is shown in FIG. 12A. FIG. 12A provides a detailed view of one of the wing tabs 82 inserted through one of the U-shaped holding tabs 52 for temporary attachment of the canopy 14 to the mounting plate 16, while wires are connected. FIG. 12A also shows how the wings 84 lie in a plane different from that of the wing tabs 82. The benefit of such design is that the wings 84 prevent the canopy 14 from falling or separating from the mounting plate's U-shaped holding tabs 52 when hung in such a manner.

Figure 13:
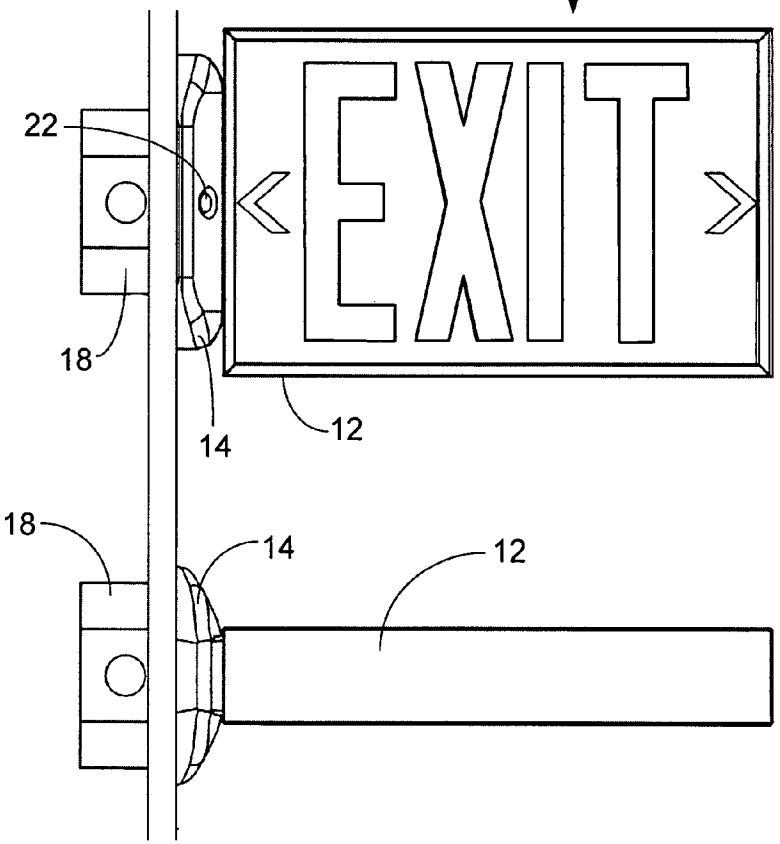
FIG. 13 shows a front and top view of the sign-type lighting fixture assembly of the present invention fully attached on the wall.

FIG. 13 shows the lighting fixture 12 in the final installation position on the wall with the canopy 14 surrounding the mounting plate 16 and only one screw 22 securing the canopy 14 to the mounting plate 16.

FIGS. 14, 15, and 15A provide examples of the present invention with a plastic canopy 90 and a plastic lighting fixture 92. With reference to FIG. 14, the plastic canopy 90 includes at least one canopy screw hole 22 and a plastic mating assembly 94 to attach the plastic lighting fixture 92 to the plastic canopy 90. Note that the only difference between the plastic canopy 90 and the metal canopy 14 is that the plastic canopy 90 contains a mating assembly 96 configured to attach the plastic canopy 90 to the plastic lighting fixture 92. The remaining components of the plastic canopy 90 and the assembly are the same as described above with the metal canopy 14.

FIG. 15 provides an example of the assembly of the present invention using the plastic canopy 90, the plastic lighting fixture 92, and the mating assembly 94. In particular, the details of the mating assembly 94 are provided in FIG. 15A. The plastic mating assembly 94 includes four snaps 96 located in the central portion of the plastic canopy 90. The four snaps allow the canopy 90 and the lighting fixture 92 to be easily snapped into place during assembly.

The mounting plate 16 and the canopy 14 of the present invention save time and ensure easy and safe installation. The lighting fixture 12 assembly allows an electrician to have two free hands when connecting the electrical wiring. The present invention also provides easy access to wires, even with the unit in place. Additionally, the present invention minimizes the amount of time an electrician spends on the ladder during installation, minimizing the risk of falls. Finally, the present invention allows easy connection to the mounting plate and securement with only one screw.

Various changes to the foregoing described and shown structures will now be evident to those skilled in the art. Accordingly, the particularly disclosed scope of the invention is set forth in the following claims.

What is claimed:

1. A sign-type lighting fixture assembly for mounting on an electrical box comprising:

a mounting plate to be affixed to said electrical box, said plate including a holding tab;

an illuminating lighting fixture;

a canopy affixed to said fixture for attaching said fixture to said mounting plate, said canopy including a wing tab for removable engagement with said holding tab, wherein said engagement of said wing tab with said holding tab supports said canopy from said mounting plate prior to said attachment of said canopy to said mounting plate for permitting connection of electrical wiring between said fixture and said electrical box; and at least one offset on an edge of the mounting plate, wherein said engagement of said wing tab with said offset secures said canopy to said mounting plate for attachment of said canopy.

2. An assembly of claim 1 wherein said holding tab contains of at least one U-shaped holding tab bent out from the mounting plate at approximately a right angle.

3. An assembly of claim 1 wherein a wing is affixed to said wing tab, said wing tab being bent out from the canopy at a right angle, and said wing lies in a plane different from said wing tab.

4. An assembly of claim 1 wherein said wing tab is engaged with said holding tab on the mounting plate, allowing removable attachment to said mounting plate without additional securement hardware.

5. An assembly of claim 1 wherein said wing tab is disengaged with said holding tab and said wing tab is engaged with said offset.

6. An assembly of claim 1 wherein said canopy contains a canopy screw hole, said canopy screw hole is positioned on a side of said canopy opposite where said wing tab and said offset are engaged.

7. An assembly of claim 1 wherein said mounting plate contains at least one mounting plate screw hole, said mounting plate screw hole is positioned on a side of said mounting plate opposite said offset.

8. An assembly of claim 1 wherein said canopy contains an aperture allowing for the passage of electrical wiring from said box to said fixture for supplying power to illuminate said fixture.

9. An assembly of claim 1 wherein said canopy is positioned on a top surface of the fixture to secure said fixture to a ceiling.

10. An assembly of claim 1 wherein said canopy is positioned on a side surface of the fixture to secure said fixture to a wall.

11. An assembly of claim 1 wherein said canopy is formed of plastic with a mating assembly configured to snap said canopy to the fixture.

12. A method of attaching a sign-type lighting fixture to an electrical box comprising:

affixing a mounting plate to said electrical box;

affixing a canopy to said lighting fixture;

securing the canopy to the mounting plate by engaging at least one wing tab from the canopy with at least one holding tab on the mounting plate wherein said engagement of said wing tab and said holding tab supports said canopy from said mounting plate without additional securement hardware;

connecting electrical wiring from said electrical box to electrical wiring of said fixture;

disengaging said wing tab from said holding tab on the mounting plate;

inserting said wing tab into an offset on an edge of the mounting plate; and securing said canopy to said mounting plate.

13. A method of attaching a sign-type lighting fixture of claim 12 wherein said holding tab contains a U-shaped holding tab bent out from the mounting plate at approximately a right angle.

14. A method of attaching a sign-type lighting fixture of claim 12 wherein said mounting plate includes at least one offset positioned along each of two opposing edges of the mounting plate.

15. A method of attaching a sign-type lighting fixture of claim 12 wherein a wing is affixed to said wing tab, said wing tab being bent out from the canopy at a right angle, and said wing lies in a plane different from said wing tab.

16. A method of attaching a sign-type lighting fixture of claim 12 wherein said wing tab is engaged with said offset after said electrical wiring is connected.

17. A method of attaching a sign-type lighting fixture of claim 12 wherein a canopy screw hole and a mounting plate screw hole are aligned and said canopy and said mounting plate are secured by inserting a screw through said canopy screw hole and said mounting plate screw hole.

18. The method of attaching a sign-type lighting fixture of claim 12 wherein said canopy is formed of plastic with a mating assembly configured to snap said canopy to the fixture.

* * * * *